United States Patent [19]

Blackburn et al.

[11] Patent Number: 4,927,458

[45] Date of Patent: May 22, 1990

[54] METHOD FOR IMPROVING THE TOUGHNESS OF BRITTLE MATERIALS FABRICATED BY POWDER METALLURGY TECHNIQUES

[75] Inventors: Martin J. Blackburn, Kensington; Michael P. Smith, Glastonbury, both of Conn.

[73] Assignee: United Technologies Corporation, Hartford, Conn.

[21] Appl. No.: 239,720

[22] Filed: Sep. 1, 1988

[51] Int. Cl.[5] ..... B22F 1/00

[52] U.S. Cl. ..... 75/246; 419/6; 419/23; 75/245

[58] Field of Search ..... 419/6, 23; 75/245, 246

[56] References Cited

U.S. PATENT DOCUMENTS

| | | | |
|---|---|---|---|
| 2,881,511 | 4/1959 | Boegehold | 29/182 |
| 4,229,216 | 10/1980 | Paton et al. | 75/175.5 |
| 4,432,795 | 2/1984 | Andersen | 75/245 |
| 4,601,874 | 7/1986 | Marty et al. | 419/23 |
| 4,602,953 | 7/1986 | Wiech, Jr. | 75/228 |
| 4,746,374 | 5/1988 | Fores et al. | 148/11.5 |
| 4,847,044 | 7/1989 | Gosh | 419/8 |

*Primary Examiner*—Stephen J. Lechert, Jr.
*Assistant Examiner*—Nina Bhat
*Attorney, Agent, or Firm*—Charles E. Sohl

[57] ABSTRACT

Methods for enhancing the toughness of otherwise brittle powder metallurgy materials are presented. Adding moderate amounts of tough particulate to such brittle material enhances their ductility in excess of that which would be predicted mathematically.

4 Claims, No Drawings

METHOD FOR IMPROVING THE TOUGHNESS OF BRITTLE MATERIALS FABRICATED BY POWDER METALLURGY TECHNIQUES

The Government has rights in this invention pursuant to a contract awarded by the Department of the Air Force.

DESCRIPTION

1. Technical Field

This invention relates to the field of powder metallurgy and particularly to the field of powder metallurgy of materials having limited ductility.

2. Background Art

Metallic materials are always subject to variety of property requirements. These may include, for example, strength, ductility, corrosion resistance, etc. Increases in strength are invariably accompanied by decreases in other important properties. Thus, for example, a great deal of interest has been expressed in alloys based on titanium aluminum intermetallic compounds such as $Ti_3Al$ and TiAl. These materials are interesting because they possess good strength at relatively elevated temperatures and relatively low densities. In general, however, these materials have not found widespread application because their toughness is generally inadequate at ambient temperatures.

DISCLOSURE OF INVENTION

A major aspect of the present invention is the disclosure of a method for increasing the toughness of brittle materials, and especially titanium aluminide materials, when fabricated by powder metallurgy techniques, by including a dispersion or array of tough particles in a less tough matrix. We have found that between about 5 and about 30 vol.% of tough particles having an average diameter of between about 50 and 300 microns can provide increases in toughness of a surprising degree, in excess of that which might normally be anticipated. The preferred volume fraction is 10–20% and the preferred tough particle diameter range is 100–200 microns.

The foregoing and other features and advantages of the present invention will become more apparent from the following description.

BEST MODE FOR CARRYING OUT THE INVENTION

According to the invention, when brittle metallic materials are fabricated by powder metallurgy their toughness can be substantially increased by including in the powder metallurgy mix a small but effect quantity of tough particles. The particles are believed to "bridge" the tip of propagating cracks thereby inhibiting further crack growth.

Toughness is a property which eludes a single definition. Generally speaking, toughness includes both a resistance to the initiation and growth of cracks. In current definitions resistance to crack growth is generally the larger part of toughness. While tough materials are usually ductile materials, the toughness parameter involves both strength and ductility and toughness can be regarded as the ability of a material to absorb energy during fracture. This is often considered as being proportional to the area under a stress-strain curve to the point of rupture.

A definitive method way of measuring and describing toughness is the use of fracture mechanics and is based on tensile or bend testing of cracked samples of specific geometry. The technique is described in ASTM specification E3-99 which is incorporated herein by reference. This test provides a measurement commonly referred to as $K_{1c}$ which is a value for fracture toughness of the material with units of ksi per square root inch or mpa per square root meter (stress/area$^{\frac{1}{2}}$) under plane strain conditions. The invention will be described below using this measure of fracture toughness, but it will appreciated that the invention is not limited by this specific fracture toughness measurement technique.

The invention will be illustrated at this point by an example which will then assist in the subsequent discussion of the details of the invention.

EXAMPLE

An alloy containing, by weight, 13.7 Al, 19 Nb, 7.8% Mo, balance Ti (atomic percent 25% Al, 10 Nb, 4 Mo, balance Ti) is a material based on $Ti_3Al$ which is known as alpha-two titanium. This particular alloy is similar to those described in U.S. Pat. Nos. 4,292,077 and 4,716,020. This material has a notably good elevated temperature tensile and creep properties, but suffers from lack of toughness especially at ambient temperatures.

An alloy containing in weight percent 7.5% Al, 38% Nb (atomic 15% Al, 22.5% Nb) has a beta structure and a notable amount of toughness but inadequate elevated temperature tensile and creep properties. These two compositions are not in equilibrium with each other. However the phase diagram proximity of the alloy compositions minimizes interdiffusion during fabrication which is a major advantage. In addition these alloys do not form brittle interfaces when bonded together.

While there are naturally occurring alloy compositions which have a microstructure which contains both the alpha-two and beta phases, such equilibrium alpha-two plus beta compositions do not provide an attractive combination of strength and toughness.

The $K_{1c}$ toughness of the previously described alpha-two composition is about 7.0 ksi per square root inch while the toughness of the previously described beta composition was about 38.8 ksi per square root inch.

One might assume that a mixture of powders of these materials when properly compacted and sintered would have the properties intermediate between the two materials and if one calculates the predicted toughness of a material containing 80% of the brittle matrix material and 20% of the ductile toughening phase one might anticipate a toughness of about 13.4 ksi per square root inch or an improvement of about 6.4 ksi per square root inch over the brittle material toughness for a material fabricated from an 80:20 mix of brittle and tough particles.

In fact, samples containing 20% by volume of 100 microns particles of this tough beta material in the brittle alpha-two matrix displayed fracture toughness values of 18.5 ksi per square root inch (an improvement of 11.5 ksi per square root inch), substantially in excess of that predicted by a rule of mixtures analysis. This then is the essence of the invention, the discovery that additions of small volume fractions of tough phase particles to a brittle metallic matrix can improve the toughness of the matrix substantially, and out of proportion to the volume of the particles added.

The Table sets forth fracture toughness values for other composite materials formed from the same matrix and tough phase compositions. The brittle matrix materials may comprise a wide variety of metallic and intermetallic compositions. These compositions are of by no means limited to the titanium-aluminide intermetallics, but may comprise alloys and compounds of other base metals including Co, Nb, Ni, Fe, Al, Mo and others.

TABLE

| Material | Condition | Toughness Ksi In.$^{\frac{1}{2}}$ |
|---|---|---|
| Actual | | |
| 100% Matrix Phase | | 7.0 |
| 100% Tough Phase | | 38.8 |
| 5% 200 Microns | Compacted (1) Solution Treated (2) | 11.7 |
| 20% 200 Microns | Annealed (3) | 14.3 |
| 5% 100 Microns | Annealed (3) | 11.4 |
| 20% 100 Microns | Annealed (3) | 18.5 |
| 20% 200 Microns | Compacted (1) Forged (4) | 16.0 |
| 5% 100 Microns | Solution Treated (2) Annealed (3) | 11.2 |
| 20% 100 Microns | Annealed (3) | 15.5 |
| Calculated | | |
| 5% Tough Phase | | 8.6 |
| 20% Tough Phase | | 13.4 |

(1) Compacted by H.I.P. at 1850° F., 2 hours, 15 ksi
(2) Solution treated at 1750° F., 1 hour
(3) Annealed at 1500° F., 4 hours
(4) Forged at 1750° F.

The second phase particles must first of all by tough and for a practical utility the second phase particles must have a fracture toughness which is at least twice that of the matrix material. The property characteristics required in the second phase particulate cannot be described quantitatively at this time. If particles are too weak they will offer little resistance to a propagating crack. Likewise, hard non deformable particles may deflect cracks but will provide no crack bridging action. The intermediate strength and toughness of the alloy used for toughening in the example cited above has many of the correct features.

Equally importantly and also difficult to define, the second phase materials must be compatible with the matrix materials. Compatibility means that the particles must bond to the matrix particles during the powder compaction process without the formation of deleterious phases in the interface between the matrix and the tough phase. Phases may be deleterious if they are weak, brittle or of low melting point relative to the intended use conditions. This can often be determined or analyzed though the use of existing phase diagrams and the knowledge of the skilled practitioner as to the interaction between metallic materials. The ultimate test of the appropriate second phase material will obviously be fabrication of the composite powder metallurgy technique and the evaluation thereof.

Another factor which may render a particular second phase useless with a particular matrix material would be excessive diffusion between the matrix and second phase even if no adverse phases are formed. Thus, if the second phase material completely dissolves in the matrix during processing or service use its effectiveness is obviously negligible.

Short of fabricating the composite material and testing it is possible to fabricate a diffusion couple between the proposed matrix and tough phase materials, and subject it to conditions approximating that which the material will see during its processing sequence and/or subsequent use and then to evaluate the couple both microscopically for the occurrence of excess diffusion and/or for the existence of suspect extraneous phases. It is also possible to fabricate a diffusion couple as previously discussed and to subject it to mechanical testing to determine the location and nature of the failure. If failure occurs away from the diffusion bond than it can safely be assumed that the materials are compatible.

If in during microscopic evaluation of the diffusion zone between the matrix and the toughening second phase, an excessive diffusion zone is observed, then a problem with interdiffusion can be anticipated. What is or is not excessive diffusion has occurred is somewhat a matter of judgement or opinion, but for guidance it can be said that if the diffusion zone is much in excess of 10% of the second phase particle diameter, this will so reduce the effective volume of the second phase particle as to make it much less effective.

Although this invention has been shown and described with respect to detailed embodiments thereof, it will be understood by those skilled in the art that various changes in form and detail thereof may be made without departing from the spirit and scope of the claimed invention.

We claim:

1. A method for increasing the toughness of a powder metallurgy brittle material which comprises:

incorporating from about 5% to about 30% by vol. of tough compatible particles having an average diameter of from about 50 to about 300 microns into the matrix, whereby the toughness of the resultant article exceeds that which would be predicted by a rule of mixture calculation.

2. An article having increased toughness which comprises:

a less tough matrix containing from about 5 to about 30 vol. percent of a tough compatible phase, said tough stable phase having a $K_{1c}$ toughness which is at least twice that of the matrix.

3. An article as in claim 2 which contains 10–20 percent by vol. of tough compatible particles.

4. An article as in claim 2 which contains tough compatible particles whose average diameter is 100–200 microns.

* * * * *